US005868559A

United States Patent [19]

Khetarpal

[11] Patent Number: 5,868,559

[45] Date of Patent: Feb. 9, 1999

[54] COMPRESSOR VANE SPRING MECHANISM

[75] Inventor: Vipen K. Khetarpal, Novi, Mich.

[73] Assignee: Ford Motor Company, Dearborn, Mich.

[21] Appl. No.: 795,214

[22] Filed: Feb. 5, 1997

[51] Int. Cl.[6] ..... F04C 18/356; F16F 1/26

[52] U.S. Cl. ..... 418/248; 267/164

[58] Field of Search ..... 418/246, 248; 267/155, 164, 170, 173

[56] References Cited

U.S. PATENT DOCUMENTS

| | | | |
|---|---|---|---|
| 2,188,003 | 1/1940 | Gates | 418/248 |
| 2,533,252 | 12/1950 | Hinckley | 418/248 |
| 2,632,398 | 3/1953 | Ferris | 418/267 |
| 3,381,584 | 5/1968 | Bartos | 418/248 |
| 4,789,145 | 12/1988 | Wenrich | 418/266 |

FOREIGN PATENT DOCUMENTS

| | | | |
|---|---|---|---|
| 66487 | 11/1956 | France | 418/248 |
| 5-223082 | 8/1993 | Japan | 418/248 |
| 1158314 | 7/1969 | United Kingdom | 418/248 |

*Primary Examiner*—John J. Vrablik
*Attorney, Agent, or Firm*—Donald A. Wilkinson

[57] ABSTRACT

A rotary compressor has a vane slot for slidably supporting a planar vane, and a transverse slot for containing a spring cartridge. The spring cartridge can be a two piece molded structure having an internal support pin for a torsion spring designed to exert a biasing force on the slidable vane. The torsion spring has a relatively large number of coil convolutions, that minimize the unit torsional stress on the spring material.

13 Claims, 2 Drawing Sheets

COMPRESSOR VANE SPRING MECHANISM

BACKGROUND OF THE INVENTION

1. Field of the Invention

This invention relates to a compressor having an improved vane spring mechanism.

2. Description of the Related Art Developments

U.S. Pat. No. 5,472,327 shows a rotary compressor that comprises a housing having an annular cavity, and an orbital ring piston in said cavity. A pair of slots in said housing slidably support two vanes for movement toward or away from the housing central axis, whereby the vanes cooperate with the outer surface of the ring piston to define variable volume compression chambers. A coil spring is arranged in each vane slot for biasing the vane into pressure contact with the ring piston.

The present invention relates to an improved spring mechanism usable in a vane type compressor for biasing a vane to a desired condition in the compression housing. The improved spring mechanism is designed to achieve an increased service life, while having a relatively low manufacturing cost and installation expense. The improved spring mechanism comprises a torsion spring mounted within a cartridge that can be readily installed in a slot cast into the compressor housing.

The use of torsion springs for vane-biasing purposes in a compressor is old in the art. U.S. Pat. No. 4,789,145 shows a torsion spring seated in a compressor vane slot for vane-biasing purposes. U.S. Pat. No. 2,533,252 shows a torsion spring associated with an arcuate vane in a rotary pump.

SUMMARY OF THE PRESENT INVENTION

The present invention is concerned with a compressor having a slidable vane and a spring cartridge seated in a transverse slot that communicates with the vane slot. The cartridge is designed for fixed removable disposition in the transverse slot, whereby the spring is precluded from undesired play or dislocation relative to the compressor housing.

The cartridge is molded to precisely fit the mounting surfaces of the spring, so as to prevent the spring from vibrating or shifting back and forth when the compressor is operating. The spring is protected against fatigue and/or wear forces that could produce premature failure.

The use of a removal cartridge as a spring mounting mechanism is further advantageous in that no special machining operations are required in the compressor housing in order to mount the spring. The cartridge can be positioned in a cast pocket in the compressor housing; no machining operations are involved, since the pocket can be formed as an incidental part of the casting process used to form the compressor housing.

In preferred practice of the invention, the spring is a wire torsion spring having two multiple coil mounting sections, and a U-shaped wire arm structure integral with the coil sections. The U-shaped wire arm comprises two parallel wire elements individually connected to the separate coil sections, whereby each coil section exerts a separate biasing force on the wire arm structure. The spring is designed to have a relatively wide safety margin as regards the stress-strain curve and fatigue strength.

Further features of the invention will be apparent from the attached drawings and description of an illustrative embodiment of the invention.

DESCRIPTION OF A PREFERRED EMBODIMENT OF THE INVENTION

Figure 1:
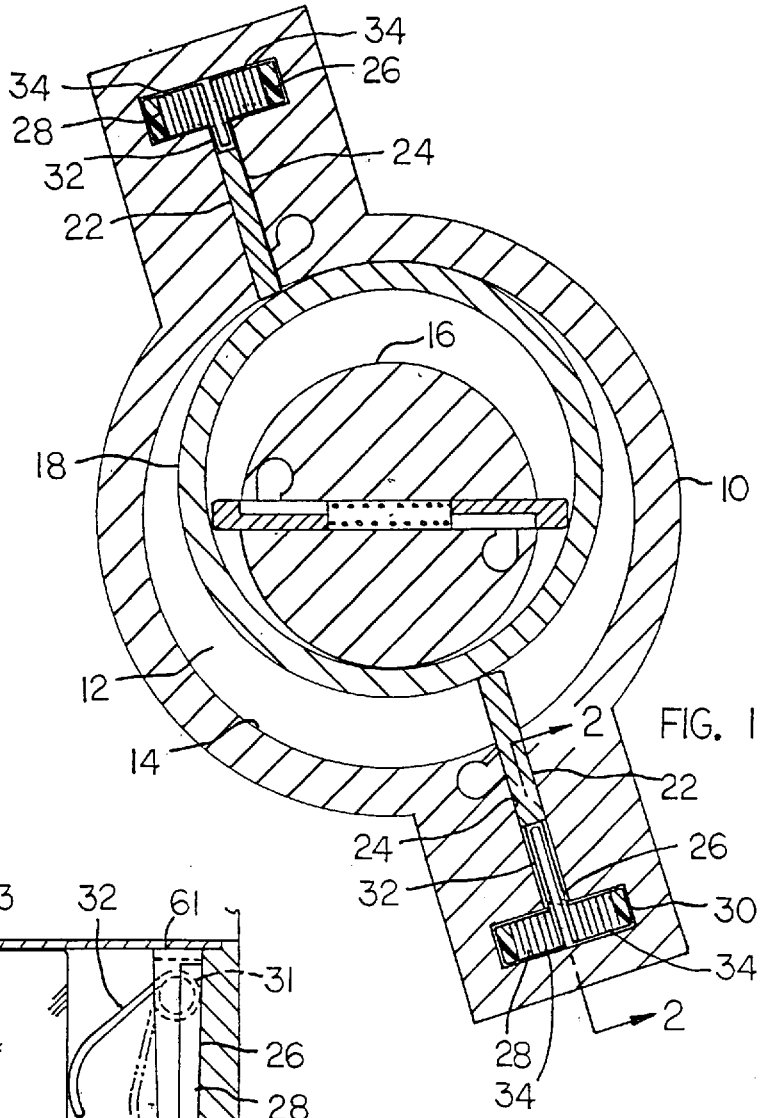
FIG. 1 is a transverse sectional view taken through a compressor having a vane spring mechanism of the present invention incorporated therein.

FIG. 1 fragmentarily shows a rotary compressor of the type shown in issued U.S. Pat. No. 5,472,327. The compressor comprises a housing 10 having an annular cavity 12 defined by a cylindrical outer surface 14 and a concentric cylindrical inner surface 16. An annular ring piston 18 is mounted for orbital motion around and within the annular cavity 12, such that the outer surface of the piston moves along cavity surface 14, and the inner surface of the piston moves along cavity surface 16 in repetitive cyclic fashion.

Compression chambers of a first stage compression cycle are formed by slidable vanes 22 mounted in vane slots 24. As ring piston 18 orbits around annular cavity 12 each vane 22 slides in and out in the associated vane slot 24. A torsion spring mechanism 26 is located at the outer end of each vane slot to exert a biasing force on the associated vane.

The compressor operates in the same general fashion as the compressor shown in above-mentioned U.S. Pat. No. 5,472,327. Reference may be had to that patent for a more detailed understanding of the compressor operation. The present invention is concerned primarily with spring mechanism 26, and the way in which the spring mechanism is mounted in the compressor housing.

Spring mechanism 26 comprises a cartridge 28 located in a transverse slot 30 at the outer end of the associated vane slot 24. A torsion spring 31 has two multiple coil mounting sections located within the cartridge and a resilient swingable arm means 32 extending out of the cartridge into vane slot 24, so that the free end of arm means 32 is in pressure contact with vane 22.

Figure 2:
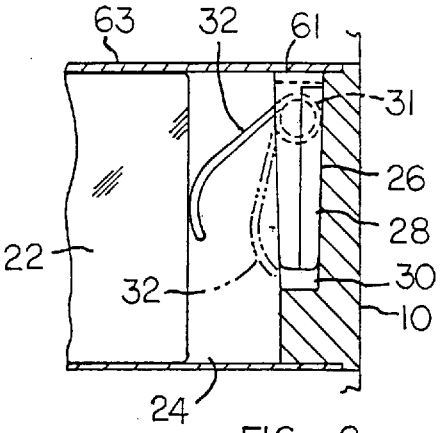
FIG. 2 is a fragmentary sectional view taken on line 2—2 in FIG. 1.
Figure 3:
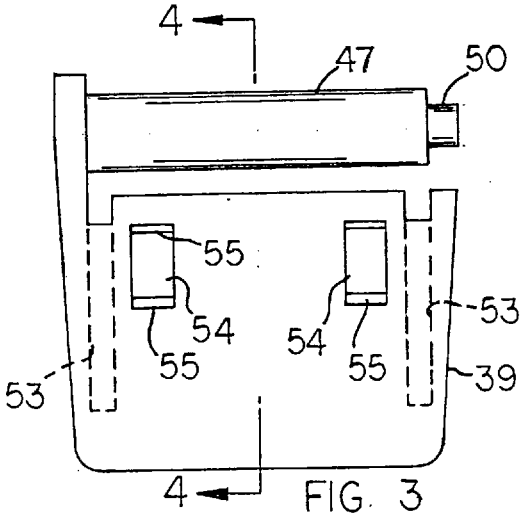
FIG. 3 is a frontal view of a cartridge wall element used in a spring cartridge employed in the FIG. 1 compressor.
Figure 4:
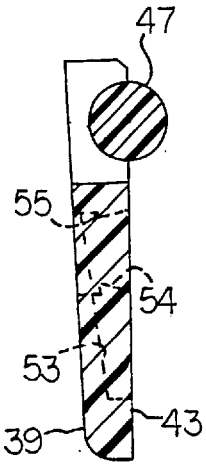
FIG. 4 is a sectional view taken on line 4—4 in FIG. 3.

FIG. 2 shows two alternate conditions of the resilient arm means 32. As shown in full lines, resilient arm means 32 is extended away from cartridge 28 to bias vane 22 away from transverse slot 30 (and toward the compressor central axis). As shown in dashed lines, resilient arm means 32 is retracted toward cartridge 28 under the force of vane 22. During compressor operation the resilient arm means 32 cycles back and forth between the two positions depicted in FIG. 2.

Figure 8:
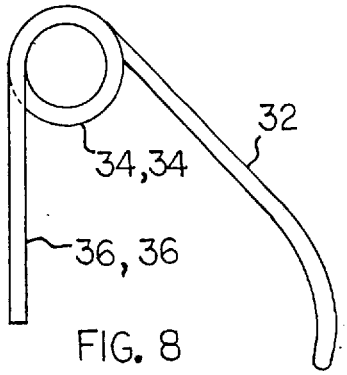
FIG. 8 is an end view of a torsion spring used in the cartridge depicted in FIG. 9.
Figure 5:
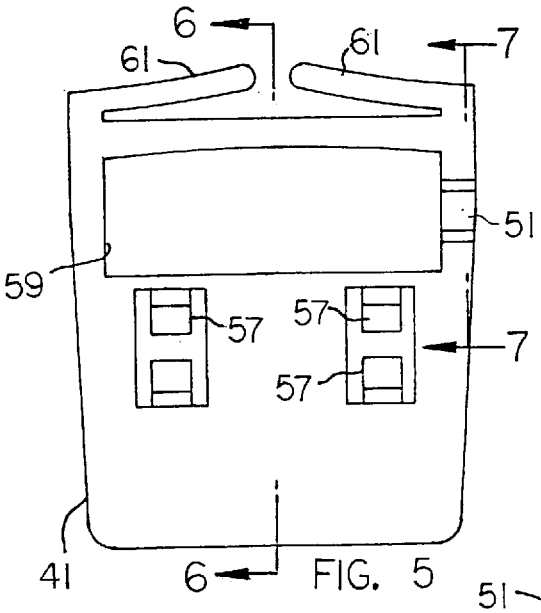
FIG. 5 is a frontal view of a second cartridge wall element used in the spring cartridge in the FIG. 1 compressor environment.
Figure 6:
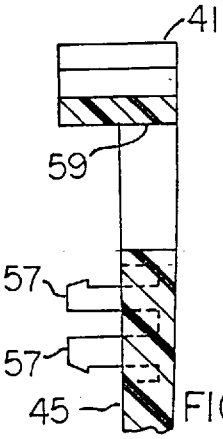
FIG. 6 is a fragmentary sectional view taken on line 6—6 in FIG. 5.
Figure 7:
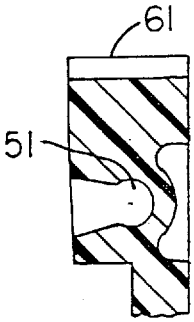
FIG. 7 is a fragmentary sectional view taken on line 7—7 in FIG. 5.
Figure 9:
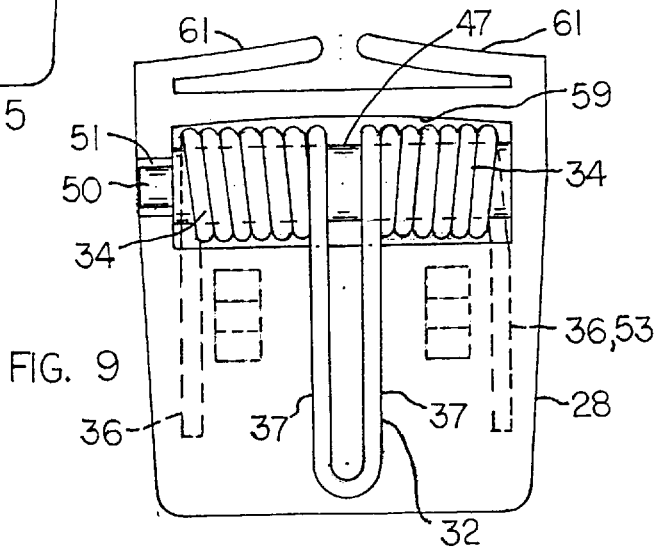
FIG. 9 is a frontal view of a cartridge constructed from the wall elements and spring of FIGS. 3, 5 and 8.

The construction of cartridge 28 and torsion spring 31 is illustrated in FIGS. 3 through 9. As shown in FIGS. 8 and 9, the torsion spring comprises a one piece spring wire that forms two multi-convolution coil sections 34, two elongated linear wire ends 36, and the aforementioned arm means 32. The swingable arm means takes the form of a U-shaped wire loop integral with coil sections 34. As viewed in FIG. 9, U-shaped wire loop 32 comprises two parallel wire elements 37 individually connected to different coil sections 34, whereby each coil section exerts a biasing force on the U-shaped arm structure.

Cartridge 28 comprises two separate flat wall members (or panels) 39 and 41, preferably formed as plastic moldings; no machining operations are required. Wall member 39 has a flat surface 43 that mates with a flat surface 45 on wall member 41, whereby the two wall members can be fastened together, to mount and support the spring.

Wall member 39 comprises a molded cylindrical pin 47 designed to fit within coil sections 34 of the spring, as shown in FIG. 9. A reduced diameter end section 50 on pin 47 is adapted to have a snap fit in a socket 51 (FIG. 7) in wall member 41, whereby pin 47 is stabilized against vibration or play.

Wall member 39 further comprises two parallel grooves 53 adapted to receive wire ends 36 of the torsion spring, whereby the spring is anchored against rotational dislocation. Additionally, wall member 39 has two rectangular openings 54 that form internal shoulders 55 cooperable with fastener arms 57 molded into wall member 41. When the two wall members 39 and 41 are snapped together, the fastener arms 57 project into openings 54 so that the hook ends on arms 57 snap over shoulders 55, thereby locking the two wall members 39 and 41 together. At the same time, socket 51 snaps onto (or around) pin end section 50. No screws or other fasteners are needed to retain the two wall members 39 and 41 together.

Wall member 41 has a rectangular clearance opening 59 that provides a space within the cartridge for the spring coil sections 34. The cartridge transverse thickness is only marginally greater than the diameter of coil sections 34, due to the central location of pin 47 in the midplane of the cartridge and the provision of clearance opening 59. The cartridge is adapted to have a removable snug fit within the transverse slot 30 (FIGS. 1 and 2) in the compressor housing.

In preferred practice of the invention, wall member 41 has two molded spring arms 61 that press against wear plate 63 (FIG. 2) when the spring cartridge is installed in the mounting slot 30. Spring arms 61 prevent the cartridge from moving in the slot so as to compensate for manufacturing tolerances.

It will be noted from FIGS. 1 and 2 that coil sections 34 of the torsion spring 31 are located in transverse slot 30, not in vane slot 24. The spring can have a relatively large number of coil convolutions, without restriction by the width of vane slot 24. The total torsional stress on the spring can be distributed to a large number of coil convolutions, such that unit stress is kept within safe limits.

The torsion spring is mounted on cartridge 28, not on mounting surfaces formed in the compressor housing. The compressor housing can be an aluminum casting having a cast slot 30; slot 30 does not have to be machined.

Cartridge 28 is designed so that it can be readily installed in slot 30 in only the correct position; the cartridge cannot be installed in an inoperative or incorrect position. This is advantageous for quality control purposes in a mass production environment.

The cartridge is designed to provide a stable mounting for coil sections 34 and wire ends 36, whereby the spring is anchored against undesired play or vibrational motion while permitting the coil convolutions to wind or unwind freely in the desired fashion.

The drawings show one particular embodiment of the invention. However, it will be appreciated that the invention can be practiced in various forms and configurations.

What is claimed:

1. A rotary compressor comprising a housing having a vane slot;

a spring accommodation slot extending transverse to said vane slot;

a vane slidably positioned in said vane slot for movement toward or away from said spring accommodation slot;

and a spring assembly occupying said spring accommodation slot;

said spring assembly comprising a cartridge removably disposed in said spring accommodation slot, and a torsion spring mounted in said cartridge;

said torsion spring having a resilient arm means extending out of said cartridge within said vane slot in pressure contact with said vane.

2. The compressor of claim 1, wherein said cartridge comprises two flat panels having mating flat surfaces defining the midplane of the cartridge.

3. The compressor of claim 2, wherein one of said panels has an integral spring-support pin centered on the midplane of the cartridge.

4. The compressor of claim 3, wherein the other panel has a rectangular clearance opening encircling said spring-support pin.

5. The compressor of claim 3, wherein said torsion spring comprises two multi-convolution coil sections surrounding said spring-support pin;

said resilient arm means comprising a U-shaped wire arm extending from said multi-convolution coil sections.

6. The compressor of claim 5, wherein said U-shaped wire arm is located in a swing plane passing transversely through said spring-support pin at a point approximately midway along the pin length.

7. The compressor of claim 1 wherein said cartridge comprises a spring-support pin;

said torsion spring comprising two multi-convolution coil sections encircling said pin;

said resilient arm mean comprising a U-shaped wire arm connected to said coil sections;

said U-shaped arm comprising two parallel wire elements, each integrally connected to one of the coil sections whereby each coil section exerts a biasing force on said arm means.

8. The compressor of claim 7, wherein said cartridge comprises two relatively flat wall elements positioned flatwise against one another;

said spring-support pin being integrally connected to one of said flat wall elements;

the other wall element having a rectangular opening slightly larger than the profile dimension of said spring coil sections whereby said coil sections occupy said openings.

9. The compressor of claim 8, wherein said cartridge has a thickness dimension only slightly larger than the diameter of each coil section.

10. The compressor of claim 1, wherein said cartridge comprises two relatively flat wall elements positioned flatwise against one another;

one of said wall elements having an integral spring-support pin thereon;

said torsion spring comprising two separate multi-convolution coil sections encircling said pin, said resilient arm means being located between said coil sections;

said one wall element having two spring-accommodation grooves therein;

each coil section having a spring wire end located in one of said grooves for anchoring said coil sections on said pin;

the other wall element having a clearance opening somewhat larger than the profile dimension of said spring coil sections, whereby said coil sections occupy said opening.

11. The compressor of claim 10, wherein said cartridge has a thickness dimension that is approximately the same as the diameter of the coil sections.

12. A rotary compressor comprising a housing having a vane slot and an intersecting spring-accommodation slot extending transverse to said vane slot;

a vane slidably positioned in said vane slot for movement toward or away from said spring accommodation slot;

and a spring mechanism occupying said spring-accommodation slot;

said spring mechanism comprising a cartridge removably disposed in said spring accommodation slot, and a torsion spring mounted in said cartridge;

said cartridge comprising first and second relatively flat walls releasably connected together in flatwise engagement so as to fit into the spring-accommodation slot without play or movement;

said first flat wall having an integral spring-support pin, and said second flat wall having a clearance opening around said pin;

said torsion spring comprising two multi-convolution coil sections encircling said pin within said clearance opening, and a U-shaped wire arm extending from said coil sections into said vane slot in pressure contact with said vane;

said first flat wall having two grooves therein, and each coil section having a spring wire end located in a respective one of said grooves for anchoring said coil sections within the cartridge.

13. The compressor of claim 12, and further comprising integral molded fastener elements on said flat walls adapted to snap fit together to fasten the walls together without screws or other fastening devices.

* * * * *